US006548190B2

(12) United States Patent
Spitsberg et al.

(10) Patent No.: US 6,548,190 B2
(45) Date of Patent: Apr. 15, 2003

(54) LOW THERMAL CONDUCTIVITY THERMAL BARRIER COATING SYSTEM AND METHOD THEREFOR

(75) Inventors: Irene Spitsberg, Loveland, OH (US); Bangalore Aswatha Nagaraj, West Chester, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/882,629

(22) Filed: Jun. 15, 2001

(65) Prior Publication Data

US 2003/0003318 A1 Jan. 2, 2003

(51) Int. Cl.[7] ..... B32B 15/04; F03B 3/12

(52) U.S. Cl. ..... 428/633; 428/632; 428/701; 428/702; 428/469; 428/699; 416/241 B

(58) Field of Search ..... 428/632, 633, 428/654, 655, 670, 680, 701, 702, 469, 699; 416/241 R, 241 B

(56) References Cited

U.S. PATENT DOCUMENTS 5,942,334 A * 8/1999 Wortman
5,985,470 A 11/1999 Spitsberg et al.
6,294,261 B1 * 9/2001 Sangeeta et al.

* cited by examiner

*Primary Examiner*—Deborah Jones
*Assistant Examiner*—Jennifer McNeil
(74) *Attorney, Agent, or Firm*—David L. Narciso; Gary M. Hartman; Domenica N. S. Hartman

(57) ABSTRACT

A multilayer thermal barrier coating (TBC) having a low thermal conductivity that is maintained or even decreases as a result of a post-deposition high temperature exposure. The TBC comprises an inner layer and an insulating layer overlying the inner layer. The inner layer is preferably yttria-stabilized zirconia (YSZ), while the insulating layer contains barium strontium aluminosilicate (BSAS). After deposition, the TBC is heated to a temperature and for a duration sufficient to cause a decrease in the thermal conductivity of the BSAS-containing layer and, consequently, the entire TBC.

14 Claims, 1 Drawing Sheet

LOW THERMAL CONDUCTIVITY THERMAL BARRIER COATING SYSTEM AND METHOD THEREFOR

STATEMENT REGARDING FEDERALLY SPONSORED RESEARCH

Not applicable.

BACKGROUND OF THE INVENTION

This invention relates to coating systems suitable for protecting components exposed to high-temperature environments, such as the hot gas flow path through a gas turbine engine. More particularly, this invention is directed to a multilayer thermal barrier coating (TBC) system characterized by a low coefficient of thermal conductivity.

The use of thermal barrier coatings (TBC) on components such as combustors, high pressure turbine (HPT) blades and vanes is increasing in commercial as well as military gas turbine engines. The thermal insulation of a TBC enables such components to survive higher operating temperatures, increases component durability, and improves engine reliability. TBC is typically a ceramic material deposited on an environmentally-protective bond coat to form what is termed a TBC system. Bond coat materials widely used in TBC systems include oxidation-resistant overlay coatings such as MCrAlX (where M is iron, cobalt and/or nickel, and X is yttrium or another rare earth element), and oxidation-resistant diffusion coatings such as diffusion aluminides that contain aluminum intermetallics.

Ceramic materials and particularly binary yttria-stabilized zirconia (YSZ) are widely used as TBC materials because of their high temperature capability, low thermal conductivity, and relative ease of deposition by air plasma spraying (APS), flame spraying and physical vapor deposition (PVD) techniques. TBC's formed by these methods have a lower thermal conductivity than a dense ceramic of the same composition as a result of the presence of microstructural defects and pores at and between grain boundaries of the TBC microstructure. TBC's employed in the highest temperature regions of gas turbine engines are often deposited by electron beam physical vapor deposition (EBPVD), which yields a columnar, strain-tolerant grain structure that is able to expand and contract without causing damaging stresses that lead to spallation. Similar columnar microstructures can be produced using other atomic and molecular vapor processes, such as sputtering (e.g., high and low pressure, standard or collimated plume), ion plasma deposition, and all forms of melting and evaporation deposition processes (e.g., cathodic arc, laser melting, etc.).

In order for a TBC to remain effective throughout the planned life cycle of the component it protects, it is important that the TBC has and maintains a low thermal conductivity throughout the life of the component, including high temperature excursions. However, the thermal conductivities of TBC materials such as YSZ are known to increase over time when subjected to the operating environment of a gas turbine engine. As a result, TBC's for gas turbine engine components are often deposited to a greater thickness than would otherwise be necessary. Alternatively, internally cooled components such as blades and nozzles must be designed to have higher cooling flow. Both of these solutions are undesirable for reasons relating to cost, component life and engine efficiency.

In view of the above, it can be appreciated that further improvements in TBC technology are desirable, particularly as TBC's are employed to thermally insulate components intended for more demanding engine designs. A TBC with lower thermal conductivity would allow for higher component surface temperatures or reduced coating thickness for the same surface temperature. Reduced TBC thickness, especially in applications like combustors which require relatively thick TBC's, would result in a significant cost reduction as well as weight benefit.

BRIEF SUMMARY OF THE INVENTION

The present invention provides a thermal barrier coating (TBC) and method by which a low thermal conductivity of the TBC is maintained or even decreased as a result of a post-deposition high temperature exposure. The TBC is part of a TBC system that includes a bond coat by which the TBC is adhered to a component surface. The TBC of this invention preferably comprises an inner layer on the bond coat and an insulating layer overlying the inner layer. According to one aspect of the invention, the inner layer preferably contains yttria-stabilized zirconia (YSZ), while the insulating layer contains barium strontium aluminosilicate (BSAS; $(Ba_{1-x}Sr_x)O—Al_2O_3—SiO_2$) The thermal conductivity ($T_c$) of BSAS is approximately equal to that of YSZ. However, the thermal conductivity of BSAS has been surprisingly observed to decrease with sufficiently high temperature exposures, with the result that, though having similar as-deposited thermal conductivities, BSAS can become a better thermal insulator than YSZ if it undergoes an appropriate thermal treatment.

Because BSAS has a low coefficient of thermal expansion (CTE) (about half that of YSZ), and therefore a BSAS coating may not adequately adhere directly to a metal substrate. In addition, alumina ($Al_2O_3$) scale that forms on aluminum-containing bond coats may react with the silica content of the BSAS coating to form silicate-type phases that would further diminish the adhesion of the coating. Therefore, the present invention provides the YSZ-containing inner layer, which has a sufficiently high CTE to mitigate the CTE mismatch between the BSAS-containing insulating layer and the underlying metal substrate (e.g., bond coat).

In view of the above, the present invention provides a TBC with a low-$T_c$ outer coating (BSAS) whose thermal conductivity is reduced from its as-deposited $T_c$ through an intentional high temperature thermal treatment. While not wishing to be held to any particular theory, the thermal conductivity of BSAS is believed to decrease with temperature exposure as a result of grain shape changes driven by the surface energy reduction, which causes pores to form in the BSAS coating. The resulting porosity decreases the thermal conductivity of the BSAS coating, with the result that the BSAS coating has significantly lower thermal conductivity than a conventional YSZ coating of the same thickness. As a result, a TBC containing a BSAS insulating layer in accordance with this invention is particularly suitable for thermally insulating components intended for demanding applications, including advanced gas turbine engines in which higher component surface temperatures are required. Alternatively, the lower thermal conductivity of the TBC allows for reduced coating thicknesses for the same surface temperature, resulting in a significant cost reduction as well as weight benefit.

Other objects and advantages of this invention will be better appreciated from the following detailed description.

DETAILED DESCRIPTION OF THE INVENTION

The present invention is generally applicable to components subjected to high temperatures, and particularly to components such as the high and low pressure turbine vanes (nozzles) and blades (buckets), shrouds, combustor liners and augmentor hardware of gas turbine engines. The invention provides a thermal barrier coating (TBC) system suitable for protecting those surfaces of a gas turbine engine component that are subjected to hot combustion gases. While the advantages of this invention will be described with reference to gas turbine engine components, the teachings of the invention are generally applicable to any component on which a TBC may be used to protect the component from a high temperature environment.

Figure 1:
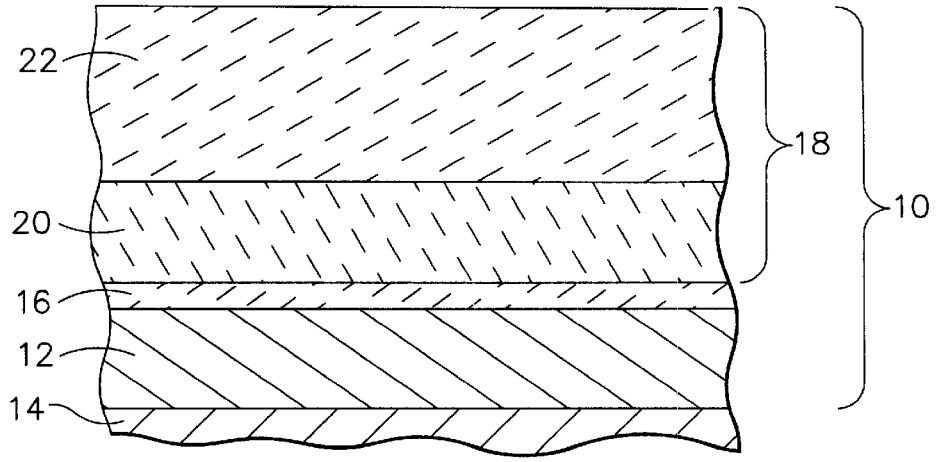
FIGS. 1 through 3 represent cross-sectional views a thermal barrier coating systems in accordance with three embodiments of the present invention.
Figure 2:
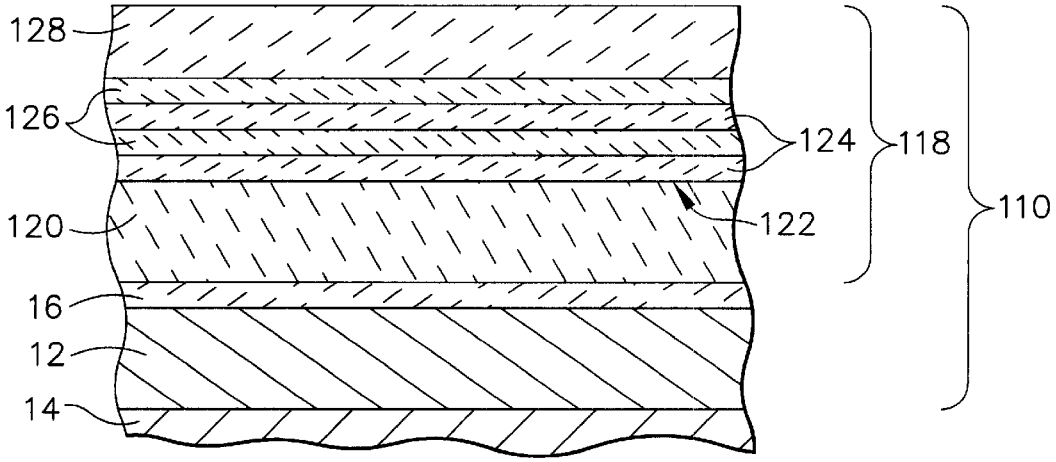
Figure 3:
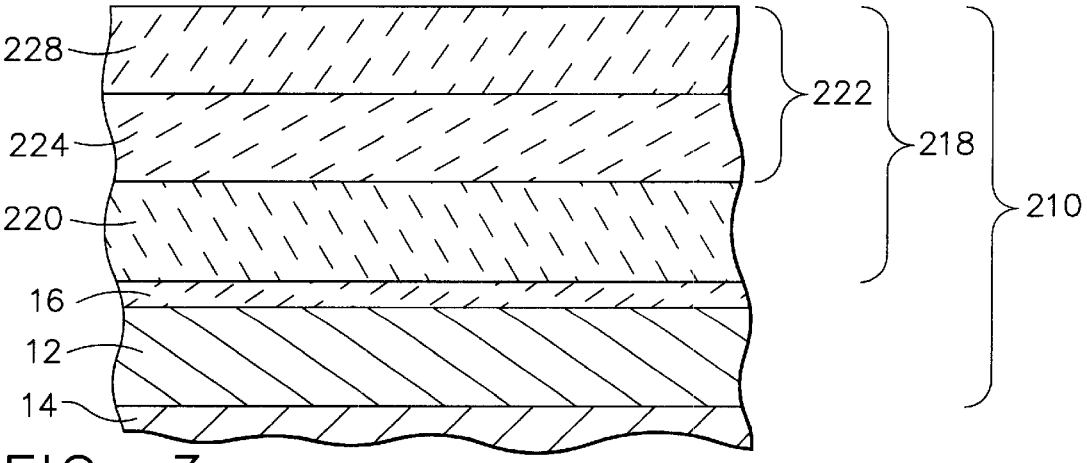

TBC systems 10, 110 and 210 in accordance with three embodiments of this invention are represented in FIGS. 1 through 3. In each embodiment, the TBC system 10, 110 or 210 is shown as including a metallic bond coat 12 that overlies the surface of a substrate 14, the latter of which is typically a superalloy and the base material of the component protected by the TBC systems 10, 110 and 210. As is typical with TBC systems for gas turbine engine components, the bond coat 12 is preferably an aluminum-rich composition, such as an overlay coating of an MCrAlX alloy or a diffusion coating such as a diffusion aluminide or a diffusion platinum aluminide of a type known in the art. Aluminum-rich bond coats of this type develop an aluminum oxide (alumina) scale 16, which is grown by oxidation of the bond coat 12. The alumina scale 16 chemically bonds a multilayer TBC 18, 118 or 218 to the bond coat 12 and substrate 14.

The TBC's 18, 118 and 218 of FIGS. 1, 2 and 3 are only schematically represented. As known in the art, one or more of the individual layers of the TBC's 18, 118 and 218 may have a strain-tolerant microstructure of columnar grains as a result of being deposited by a physical vapor deposition technique, such as EBPVD. Alternatively, one or more of the layers may have a noncolumnar structure as a result of being deposited by such methods as plasma spraying, including air plasma spraying (APS). Layers of this type are in the form of molten "splats," resulting in a microstructure characterized by irregular flattened grains and a degree of inhomogeneity and porosity. In each case, the process by which the layers of the TBC 18, 118 and 218 are deposited provides microstructural defects and pores that are believed to decrease the thermal conductivity of the TBC 18, 118 and 218.

The present invention provides compositions and structures for the TBC's 18, 118 and 218 that further reduce thermal conductivity as a result of including a layer that contains barium strontium aluminosilicate (BSAS; $(Ba_{1-x}Sr_x)O—Al_2O_3—SiO_2$) Similar to YSZ, BSAS is not volatile in water vapor at high temperatures, and therefore would be expected to be capable of surviving the hostile environment of the hot gas path within a gas turbine engine. However, while preliminary data indicated that the thermal conductivity ($T_c$) of BSAS is slightly lower than YSZ, the CTE of BSAS is about half that of YSZ. The $T_c$ and CTE data for YSZ and BSAS are summarized in Table 1 below ("RT" stands for "room temperature," or about 25° C.).

TABLE 1

| Material | CTE (RT to 1200° C.) ($\times 10^{-6}$/° C.) | Melting Temperature (° C.) | Thermal Conductivity at RT (W/mK) |
|---|---|---|---|
| YSZ | 9.40 | about 2600 | >2 |
| BSAS | 5.27 | about 1700 | 1.72 |

Because BSAS has a significant CTE mismatch with metal surfaces, a BSAS coating would be expected to be prone to spallation from the bond coat 12 or metal substrate 14. Another problem with the use of BSAS in a TBC system is that the alumina scale 16 that forms on the surface of the bond coat 12 would be expected to have a tendency to react with the silica content of a BSAS coating, forming silicate-type phases that could promote interface degradation and failure from thermal fatigue. In view of these concerns, and because BSAS would be expected to provide only a modest improvement in thermal insulation, BSAS has not been utilized as a thermal-insulating layer for high temperature (e.g., gas turbine engine) applications.

Notwithstanding the above concerns, the present invention provides several different approaches to incorporating a BSAS-containing layer into the TBC systems 10, 110 and 210 of this invention. Contrary to the thermal data of Table 1, it was unexpectedly determined that the thermal conductivity of BSAS actually decreases with prolonged exposures to elevated temperatures. In one investigation, the thermal conductivity of air plasma sprayed (APS) BSAS coatings was measured in the as-deposited condition, after aging for about five hours at about 1482° C., and after aging for about fifty hours at about 1482° C. The measurements were made at temperatures of about 820° C., 890° C. and 990° C. The averages of these measurements are summarized in Table 2 below. It should be noted that the conductivities of the as-deposited BSAS specimens in Table 2 are lower than the conductivity indicated in Table 1 because Table 1 is based on bulk BSAS at room temperature, while Table 2 is based on plasma sprayed BSAS at elevated temperatures.

TABLE 2

| Thermal Treatment | Thermal Conductivity (W/mK) at: | | |
|---|---|---|---|
| (Time/Temperature) | 820° C. | 890° C. | 990° C. |
| As-deposited | 1.53 | 1.51 | 1.53 |
| 5 hrs./1482° C. | 1.28 | 1.30 | 1.33 |
| 50 hrs./1482° C. | 1.33 | 1.32 | 1.35 |

The above results indicated that a significant improvement in thermal insulation could be achieved by the incorporation of BSAS into a TBC if the BSAS coating was subjected to an appropriate thermal treatment. While not wishing to be held to any particular theory, the basis for the decreasing thermal conductivity of BSAS evident in Table 2 is believed to be related to increased porosity created as a result of changes in grain shape driven by surface energy reduction during high temperature excursions. Thermal treatments sufficient to significantly decrease the thermal conductivity of BSAS (i.e,. below about 1.5 w/mK) are generally believed to be at least about 1200° C. if held for at least two hours.

On the basis of the above results, the present invention provides the several approaches represented in FIGS. 1 through 3 for incorporating a BSAS-containing layer into the TBC systems 10, 110 and 210. With reference to FIG. 1, the TBC 18 is shown as comprising an inner layer 20 lying directly on the bond coat 12 and a single outer layer 22 lying directly on the inner layer 20. A preferred composition for the inner layer 20 is based on binary yttria-stabilized zirconia (YSZ), a particular notable example of which contains about 6 to about 8 weight percent yttria, with the balance zirconia. Other zirconia-based ceramic materials could also be used with this invention, such as zirconia fully stabilized by yttria, nonstabilized zirconia, or zirconia partially or fully stabilized by ceria, magnesia, scandia and/or other oxides. According to one aspect of the invention, a particularly suitable material for the inner layer 20 is YSZ containing about 4 to about 8 weight percent yttria (4–8% YSZ). In the embodiment of FIG. 1, the outer layer 22 is entirely BSAS. According to a preferred aspect of the first embodiment of FIG. 1, the inner layer 20 is deposited to a thickness that is sufficient to provide a suitable stress distribution within the TBC system 10 to promote the mechanical integrity of the coating. A suitable thickness for this purpose is generally on the order of about 3 to about 30 mils (about 75 to about 750 micrometers), which is also believed to be sufficient to provide a physical barrier to a possible reaction between the alumina scale 16 and the silica content of the BSAS outer layer 22. The BSAS outer layer 22 is sufficiently thick to provide the desired level of thermal insulation in combination with the YSZ inner layer 20. While coating thickness depends on the particular application, a thickness ratio of YSZ/BSAS of about one is believed to be suitable, such that a suitable thickness for the BSAS outer layer 22 is also about 3 to about 30 mils (about 75 to about 750 micrometers).

In FIG. 2, the TBC 118 differs from the TBC 18 of FIG. 1 by having a multilayer outer coating 122. As before, an inner layer 120 lies directly on the bond coat 12, and the outer coating 122 lies directly on the inner layer 120. A preferred composition for the inner layer 120 is again based on YSZ, preferably 3–20% YSZ. In contrast to the embodiment of FIG. 1, the outer coating 122 is formed to include a graded region of alternating thin YSZ and BSAS layers 124 and 126, respectively, followed by an outer layer 128 formed entirely of YSZ. The YSZ layers 124 and 128 may have the same composition as the inner layer 120 (3–20% YSZ), though it is foreseeable that their compositions could differ. For example, a higher yttria content may be desired in the outer YSZ layer 128 to improve high temperature phase stability, or a lower yttria content may be desired to improve erosion resistance.

In the embodiment of FIG. 2, the YSZ inner layer 120 promotes stress distribution between the bond coat 12 and the TBC 118, the BSAS layers 126 serve to reduce the overall thermal conductivity of the TBC 118, the YSZ outer layer 128 promotes the erosion resistance of the TBC 118, and the thin YSZ layers 124 provide a grading effect between the BSAS layers 126 and the YSZ inner and outer layers 120 and 128. As such, the YSZ inner layer 120 can have a thickness similar to that of the YSZ inner layer 20 of FIG. 1. The individual thin layers 124 and 126 preferably have thicknesses of about 2 mils (about 50 micrometers) for a combined thickness of about 10 to about 30 mils (about 250 to about 750 micrometers), though thicknesses of as little as 5 (about 125 micrometers) and as much as 50 (about 1250 micrometers) are foreseeable. The combined thickness of the BSAS layers 126 preferably constitutes at least about one-third of the combined thickness of the YSZ layers 124 in order for the TBC 118 to contain sufficient BSAS to have a significant impact on heat transfer. Any number of YSZ and BSAS layers 124 and 126 can be combined to form the graded region of the outer coating 122. However, the layers 124 and 126 are preferably arranged so that the layer contacting the YSZ inner layer 120 is YSZ to promote mechanical compliance. The YSZ outer layer 128 should be sufficiently thick to provide erosion protection to the graded layers 124 and 126. A suitable thickness for this purpose is generally on the order of up to about 10 mils (about 250 micrometers).

In FIG. 3, the TBC 218 is similar to that of FIG. 2 by the inclusion of a YSZ inner layer 220 and a multilayer outer coating 222 that includes a YSZ outer layer 228. However, the TBC 218 differs in that the outer coating 222 comprises a BSAS/YSZ composite layer 224 between the inner and outer YSZ layers 220 and 228. A preferred composition for the composite layer 224 is a uniform mixture of about 25 to about 75 weight percent BSAS, with the balance 4–8% YSZ. Equal parts of BSAS and YSZ in the composite layer 224 are believed to provide an adequate stress field. The stated range for the BSAS/YSZ ratio is believed to achieve stress distribution for varying relative thicknesses of the YSZ inner and outer layers 220 and 228. A suitable thickness for the composite layer 224 is up to about 10 mils (about 250 micrometers), preferably about 4 to about 7 mils (about 100 to about 175 micrometers). The composition and thickness of the composite layer 224 provide a sufficient amount of BSAS to significantly lower the thermal conductivity of the TBC 218. For the same reasons discussed above, suitable thicknesses for the YSZ inner and outer layers 220 and 228 are again up to about 10 mils (about 250 micrometers).

In view of the above, it can be appreciated that each of the TBC systems 10, 110 and 210 of this invention employs a TBC 18, 118 and 218 whose thermal conductivity is reduced by the addition of a constituent having a lower thermal conductivity than YSZ and other conventional TBC materials. Because a larger CTE mismatch exists with a metal bond coat 12 and substrate 14 when BSAS is used as the low thermal conductivity material, each of the TBC's 18, 118 and 218 includes an intermediate YSZ layer 20, 120 or 220 that reduces the CTE mismatch. The TBC's 118 and 218 also employ an outer layer 128 and 228 that is entirely or predominantly YSZ, whose erosion resistance properties are better than BSAS and conventional TBC materials.

While the invention has been described in terms of a preferred embodiment, it is apparent that other forms could be adopted by one skilled in the art. Therefore, the scope of the invention is to be limited only by the following claims.

What is claimed is:

1. A multilayer thermal barrier coating on a metal surface of a component, the thermal barrier coating comprising an inner layer containing yttria-stabilized zirconia on the surface of the component and an insulating layer containing barium strontium aluminosilicate overlying the inner layer, the thermal conductivity of the barium strontium aluminosilicate within the insulating layer being less than 1.5 W/mK.

2. A multilayer thermal barrier coating according to claim 1, wherein the inner layer consists essentially of yttria-stabilized zirconia.

3. A multilayer thermal barrier coating according to claim 1, wherein the insulating layer consists essentially of barium strontium aluminosilicate.

4. A multilayer thermal barrier coating according to claim 3, wherein the thermal conductivity of the insulating layer is less than 1.4 W/mK.

5. A multilayer thermal barrier coating according to claim 1, wherein the inner layer consists of yttria-stabilized zirconia, and the insulating layer consists of barium strontium aluminosilicate and has a thermal conductivity of less than 1.4 W/mK.

6. A multilayer thermal barrier coating according to claim 1, wherein the insulating layer comprises alternating layers of yttria-stabilized zirconia and barium strontium aluminosilicate.

7. A multilayer thermal barrier coating according to claim 6, wherein the thermal conductivity of the barium strontium aluminosilicate layers is less than 1.4 W/mK.

8. A multilayer thermal barrier coating according to claim 6, further comprising an outer layer of yttria-stabilized zirconia overlying the alternating layers of yttria-stabilized zirconia and barium strontium aluminosilicate.

9. A multilayer thermal barrier coating according to claim 1, wherein the insulating layer comprises a mixture of yttria-stabilized zirconia and barium strontium aluminosilicate.

10. A multilayer thermal barrier coating according to claim 9, further comprising an outer layer of yttria-stabilized zirconia overlying the mixture of yttria-stabilized zirconia and barium strontium aluminosilicate.

11. A thermal barrier coating system on a surface of a gas turbine engine component, the thermal barrier coating system comprising a metallic bond coat and a multilayer thermal baffler coating, the thermal barrier coating comprising an inner layer consisting of yttria-stabilized zirconia on the bond coat and an insulating layer containing barium strontium aluminosilicate overlying the inner layer, the thermal conductivity of the barium strontium aluminosilicate within the insulating layer being less than 1.5 W/mK.

12. A thermal baffler coating system according to claim 11, wherein the insulating layer consists of barium strontium aluminosilicate and has a thermal conductivity of less than 1.4 W/mK.

13. A thermal baffler coating system according to claim 11, wherein the insulating layer consists of alternating layers of yttria-stabilized zirconia and barium strontium aluminosilicate and an outer layer of yttria-stabilized zirconia overlying the alternating layers of yttria-stabilized zirconia and barium strontium aluminosilicate, the thermal conductivity of the barium strontium aluminosilicate layers being less than 1.4 W/mK.

14. A thermal barrier coating system according to claim 11, wherein the insulating layer consists of a mixed layer of yttria-stabilized zirconia and barium strontium aluminosilicate and an outer layer of yttria-stabilized zirconia overlying the mixed layer of yttria-stabilized zirconia and barium strontium aluminosilicate.

* * * * *